US005552815A

United States Patent [19]

Shimoda

[11] Patent Number: 5,552,815

[45] Date of Patent: Sep. 3, 1996

[54] INK JET APPARATUS INCLUDING MEANS FOR REGULATING AN AMOUNT OF INK AND AN AMOUNT OF AIR IN AN INK TANK RELATIVE TO EACH OTHER

[75] Inventor: Junji Shimoda, Chigasaki, Japan

[73] Assignee: Canon Kabushiki Kaisha, Tokyo, Japan

[21] Appl. No.: 972,367

[22] Filed: Nov. 5, 1992

[30] Foreign Application Priority Data

Nov. 6, 1991 [JP] Japan ..... 3-290082

[51] Int. Cl.[6] ..... B41J 2/175; B41J 2/165

[52] U.S. Cl. ..... 347/85; 347/30

[58] Field of Search ..... 346/140 R; 347/29, 347/30, 85, 92

[56] References Cited

U.S. PATENT DOCUMENTS

| | | | |
|---|---|---|---|
| 4,350,448 | 9/1982 | Hanagata et al. | 346/76 PH |
| 4,383,263 | 5/1983 | Ozawa et al. | 346/140 R |
| 4,403,233 | 9/1983 | Terasawa et al. | 346/140 R |
| 4,492,969 | 1/1985 | Terasawa | 346/140 R |
| 4,510,510 | 4/1985 | Terasawa | 346/140 R |
| 4,577,203 | 3/1986 | Kawamura | 347/30 |
| 4,677,448 | 6/1987 | Mizusawa et al. | 346/140 R |
| 4,847,637 | 7/1989 | Watanabe et al. | 346/140 R |
| 4,876,558 | 10/1989 | Mamiya | 346/140 R |
| 5,159,348 | 10/1992 | Dietl et al. | 346/140 R X |

FOREIGN PATENT DOCUMENTS

| | | | |
|---|---|---|---|
| 0204562 | 11/1984 | Japan | B41J 3/04 |
| 60-143967 | 7/1985 | Japan | 347/30 |
| 3224959 | 9/1988 | Japan | B41J 3/04 |

*Primary Examiner*—Benjamin R. Fuller
*Assistant Examiner*—David Yockey
*Attorney, Agent, or Firm*—Fitzpatrick, Cella, Harper & Scinto

[57] ABSTRACT

Disclosed is an ink jet apparatus having a head for forming an image picture on a recording paper, a subsidiary ink tank detachably coupled to the head for accommodating ink and air therein, and a carriage on which the head and the subsidiary ink tank are mounted and used for scanning the recording region. The subsidiary ink tank includes an opening to be coupled to a suction device for adjusting amounts of ink and air accommodated in the interior thereof, and a valve mechanism which assumes an open state when it is coupled to the suction device and a closed state when it is disconnected therefrom.

2 Claims, 5 Drawing Sheets

INK JET APPARATUS INCLUDING MEANS FOR REGULATING AN AMOUNT OF INK AND AN AMOUNT OF AIR IN AN INK TANK RELATIVE TO EACH OTHER

BACKGROUND OF THE INVENTION

1. Field of the Invention

The present invention generally relates to an ink jet apparatus for forming a given picture image by discharging drops of ink from a discharge port on a recording medium, and more particularly to an ink jet apparatus additionally provided with an improved ink supply mechanism which maintains in good condition the presence of ink within a subsidiary ink tank interposed between a main ink tank and a head.

2. Related Background Art

In a conventional ink jet apparatus, an ink supply system for supplying ink from a main ink tank to a head portion had been so constructed as schematically illustrated in FIG. 6, for example. That is, it is constructed as a system comprising a permanent type head 31 with a subsidiary ink tank, an ink tank 32 for storing ink to be supplied to the head 31 and adapted to be replaceable with respect to the apparatus, a tube 33 connecting the head 31 and the ink tank 32 and used to supply ink therebetween, pump means 34 used for sucking ink from a discharge port 37 of the head 31 and provided with a cap 40 effecting the recovery of ink discharge state, and a tube 35 coupled to part of the subsidiary ink tank of a head different from the discharge port 37 and used for coupling the subsidiary ink tank of the head and the pump means in order to maintain the ink level within the subsidiary ink tank constant by the pump means 34.

Furthermore, as another example, the pump and the subsidiary ink tank are not directly coupled by means of a tube as illustrated in FIG. 7 so as to provide a thin sucking tube 45 above a discharge port 47 to keep the ink level within a subsidiary ink tank 46 of a head 41 constant, contacting a cap 50 against the discharge port 47, and causing ink or air to discharge from the thin tube 45 simultaneously with the recovery of sucking.

However, in the former example, there was required the suction tube 35 in addition to the supply tube 33. Accordingly, two deformable tubes are provided when the ink jet head 31 is mounted on a carriage scanning parallel to the recording medium so that it is difficult to arrange the tubes 33 and 35 within the apparatus, thus leading not only to an increase in production cost, but also to an increase in motor load necessary for the carriage scanning. In addition, fears were entertained that the ink within the suction tubes arranged inside the apparatus may suffer from pressure caused by the scanning of the carriage, and unnecessary variations of pressure against the subsidiary ink tank may occur.

In the examples described above, since the ink jet head 31, 41 and the subsidiary ink tank having various functions of holding ink and air therein, relaxing the pressure variations caused by the carriage scanning, stabilizing the formation of drops of a recording liquid and the discharge thereof, trapping bubbles within the ink tank supply tube, and causing the bubbles not to efflux into the nozzle, are integrally molded into the same member, there is such a drawback that the replacement and repair of the ink jet head by users or repair men at the time of various troubles such as damage to the ink jet heads 31, 41 due to paper jamming, abnormal discharge of ink due to the sticking of foreign matters and the like could not be readily carried out.

In addition, in the later example, since the suction tube 45 used for maintaining the ink level within the subsidiary ink tank constant is made of one thin tube and was constituted in such fashion that it is open externally, there is a fear of effluxing the internal ink toward the outside or taking-in the air from the outside due to the pressure variations within the subsidiary ink tank caused by the carriage scanning at the time of recording, thus leading to a decrease in reliability of the supply of ink.

SUMMARY OF THE INVENTION

Accordingly, the present invention has been proposed to improve the above-mentioned technical problems in the prior art, and one object of which is to enable the stable supply of ink to the head, thereby achieving the elevation of recording characteristics.

It is another object of the present invention to provide an ink supply structure of simple construction with higher reliability, which does not suffer from the influence of pressure variations, even in the case where the head is scanned.

It is a further object of the present invention to provide an ink jet apparatus comprising a head for forming an image picture by discharging ink, a subsidiary ink tank to which the head is detachably coupled, and a carriage on which the head and the subsidiary ink tank are mounted and used for scanning a recording region and a non-recording region. The subsidiary ink tank includes an opening to be coupled with suction means to adjust the amounts of ink and air to be accommodated inside, and a valve mechanism which assumes an open state by coupling to the suction means and a closed state by being disconnected from the suction means.

DETAILED DESCRIPTION OF THE PREFERRED EMBODIMENTS

Figure 1:
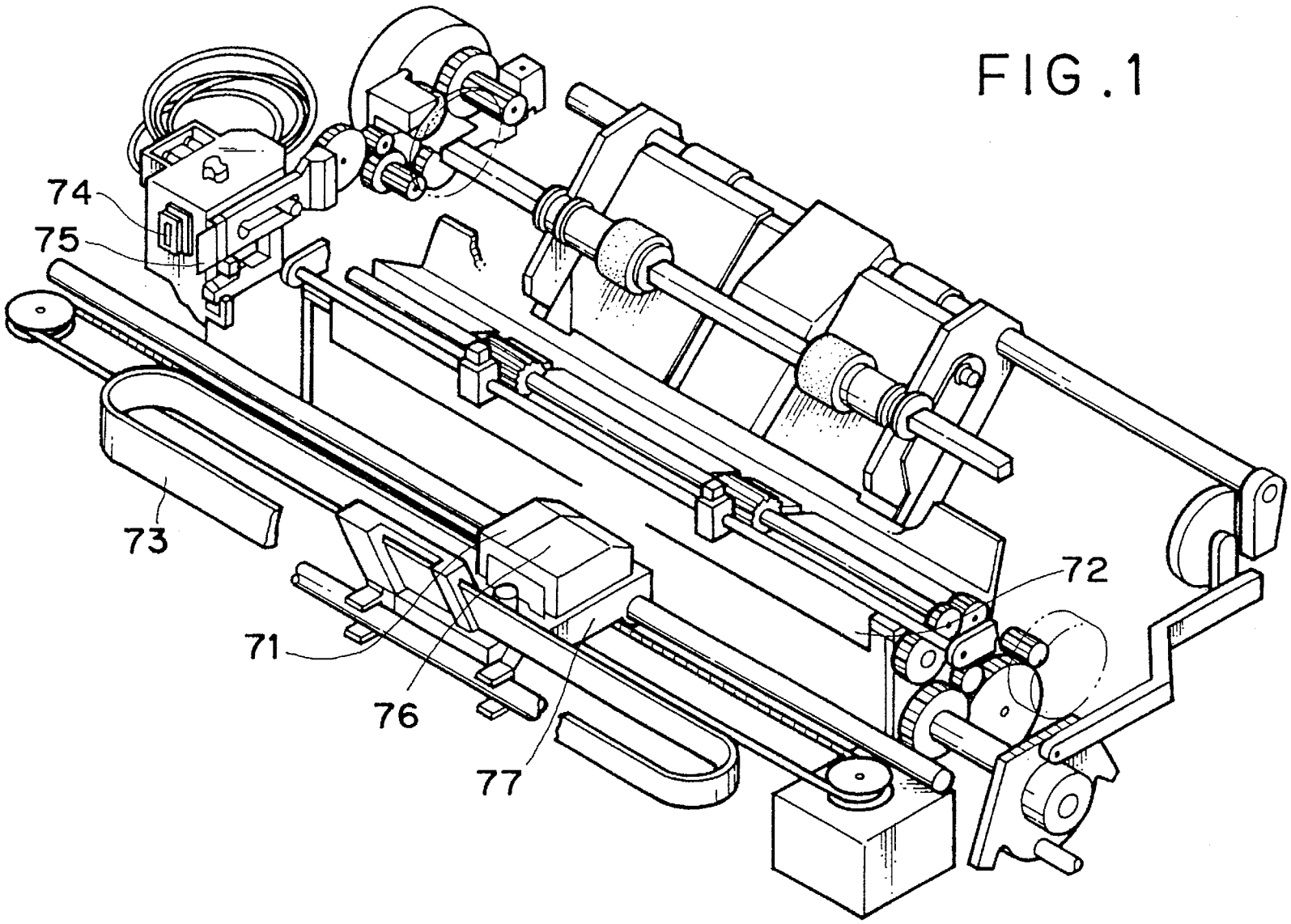
FIG. 1 is a perspective view showing an outline of an ink jet recording apparatus in accordance with the present invention.

In FIG. 1, there is illustrated an outline of an ink jet recording apparatus in accordance with the present invention. In FIG. 1, a reference numeral 71 shows an ink jet head for discharging drops of liquid on a recording paper, 76 shows a subsidiary ink tank for holding ink and air within the inside thereof, and 77 shows a carriage to which the ink jet head 71 and the subsidiary ink tank 76 are fixed and used for scanning in the direction parallel to the recording paper.

In addition, a reference numeral 73 shows a supply tube extending from a not-shown replaceable main tank to the subsidiary ink tank 76 and the ink jet head 71 and used for supplying ink thereto.

In addition, a platen 72 defining a recording surface of a recording medium is disposed on the opposite surface of the head 71 in the recording region.

Disposed on the opposite surface of the head 71 in a non-recording region deviated from the recording region is a cap 74 which covers the discharge port of the head to effect the protection of the discharge port and the recovery processing of the discharge port. A cleaning member 75 is disposed between the cap 74 and the recording region to remove the ink or foreign matters, if any, stuck to the discharge port forming surface of the head 71 by sliding thereon. The cap 74 covers the head 71 and is coupled to pump means (not shown) for generating appropriate negative pressures against the discharge port.

Figure 2A:
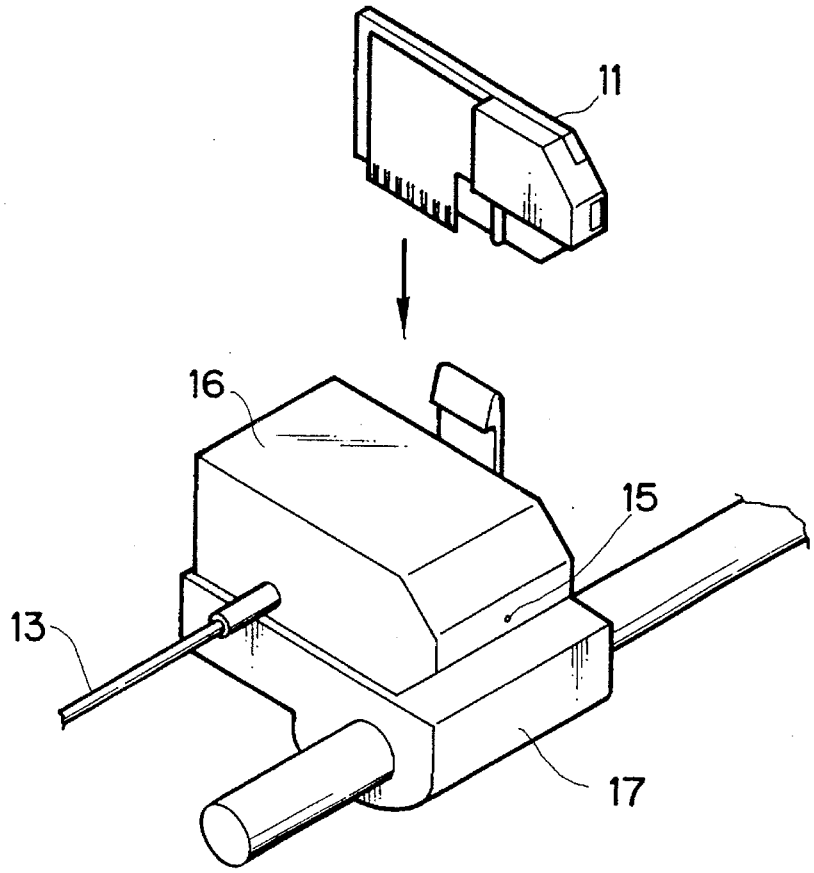
FIGS. 2A and 2B are explanatory diagrams of an ink jet head and a subsidiary ink tank which are main components of the present invention.
Figure 2B:
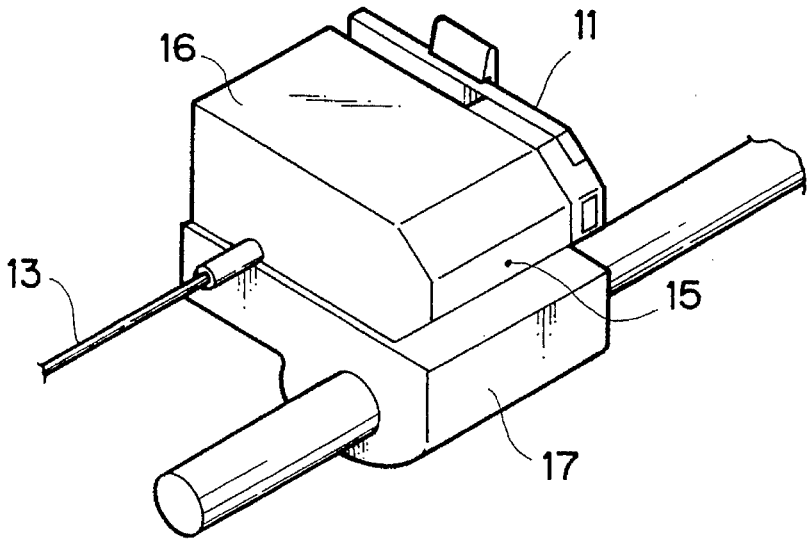

In FIGS. 2A and 2B, which illustrate one example of a main portion of the embodiment in accordance with the present invention, a reference numeral 11 shows an ink jet head composed of a discharge port for discharging drops of ink, an ink passage communicating with the discharge port, an electromechanical conversion element or electrothermal conversion element which is an energy generator for discharging drops of ink, and a common liquid chamber communicating with a plurality of nozzles used for supplying ink.

In the present invention, a subsidiary ink tank 16 is formed as a separate member from the ink jet head 11 as shown in FIG. 2A and the head 11 is so constituted that it can be removed from the subsidiary ink tank. The subsidiary ink tank 16 holds, at the inside thereof, the ink to be supplied to the ink jet head 11, and an air layer which functions to relax internal pressure variations induced as the result of scanning of the ink jet head 11, to stabilize the formation of drops of recording liquid and its discharge, and to prevent the efflux of bubbles into the ink jet head 11 by trapping the bubbles within the ink tank and the supply system. The subsidiary ink tank 16 has an ink supply opening for supplying the ink to the ink jet head 11, and an ink injection opening communicating with a not-shown replaceable ink tank. A suction opening 15 is used to maintain the ink level and the amount of air within the subsidiary ink tank 16 constant and is located above the ink supply opening and the ink injection opening formed on the ink tank 16. The suction inlet 15 will be closed to isolate the inside and outside upon a predetermined pressure variation inside the subsidiary ink tank 16 induced due to the level difference of ink between the ink tank and the subsidiary ink tank 16, and the scanning of the ink jet head 11 and the subsidiary ink tank 16, but will be opened only when the suction opening 15 is absorbed by a not-shown suction pump at a negative pressure higher than a predetermined value, to thereby discharge the ink and air within the subsidiary ink tank 16 toward the outside.

A deformable supply tube 13 is used to couple the ink injection opening within the subsidiary ink tank 16 to a main tank (not shown), and to supply ink.

A carriage 17 is used to secure the ink jet head 11 and the subsidiary ink tank 16, respectively, and to scan the ink jet head 11 in opposition to the recording medium.

As clearly understood from FIGS. 2A and 2B, the ink jet head 11 is so constituted that it can be readily replaced by itself without including the ink supply system such as the subsidiary ink tank 16 and others by the users or repair men when any fault such as abnormal ink discharge operation occurs due to damage by paper jamming and sticking of foreign matters or the like, and fixedly mounted on the carriage by inserting a connector and an ink coupling portion disposed within the head 11 into the carriage 17 and the subsidiary ink tank 16.

Figure 3:
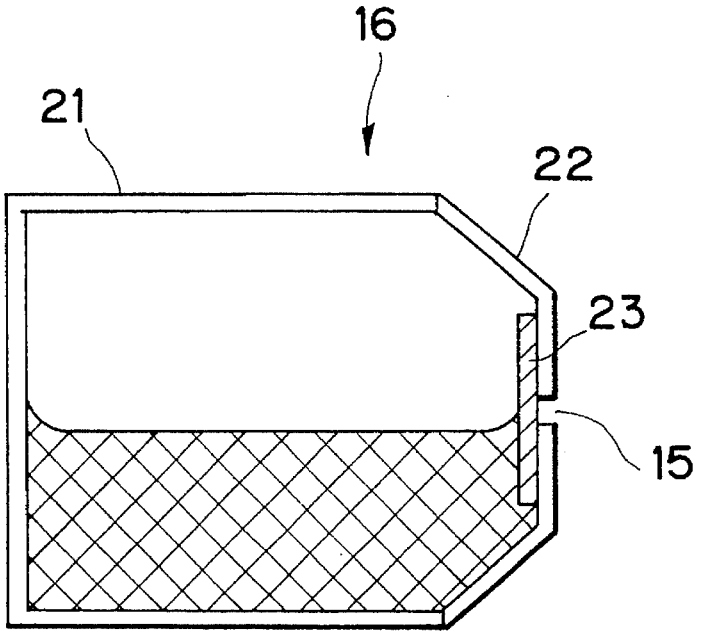
FIG. 3 is a sectional view showing one example of an ink suction opening of the subsidiary ink tank.

In FIG. 3, there is illustrated one preferred embodiment of the ink suction opening 15 in the subsidiary ink tank 16, which corresponds to one of the important features of the present invention. Reference numerals 21 and 22 show parts used for forming the subsidiary ink tank 16 and fabricated by injection molding, for example, and these parts are adhered to each other by ultrasonic welding or any appropriate adhesive. As a hydrophilic-porous member 23, a porous film made of polypropylene, polyethylene and the like, or a sintered body or the like may be used. The porous member 23 is adhered to the component 22 by ultrasonic welding or any appropriate adhesive. Since the inside of the subsidiary ink tank is filled with ink and air, the hydrophilic-porous member 23 acts to interrupt the communication between the inside and the outside of the suction opening 15 at a small negative pressure caused by the level difference of ink in the ink tank and the subsidiary ink tank 16. However, the ink and the air within the subsidiary ink tank 16 can pass through it at a larger negative pressure induced by a not-shown suction pump.

Figure 4:
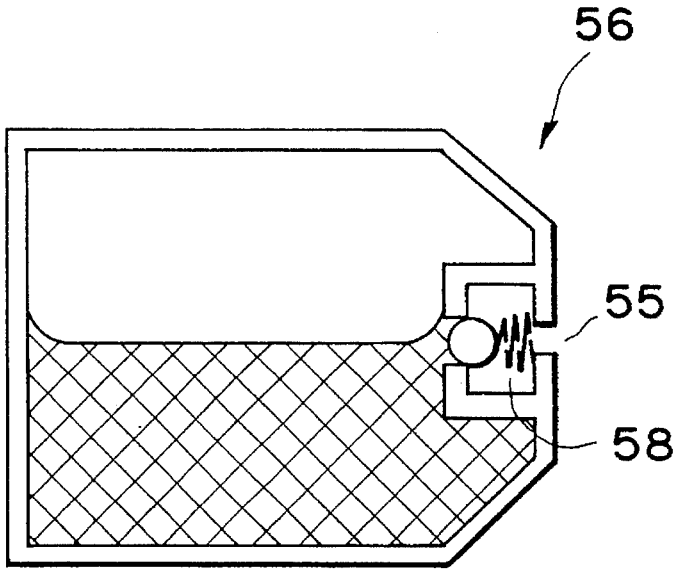
FIG. 4 is a sectional view showing another example of an ink suction opening of the subsidiary ink tank.

In FIG. 4, there is illustrated another embodiment of the present invention.

This embodiment comprises a subsidiary ink tank 56 having a predetermined amount of ink and air therein, a suction opening 55 used for maintaining an ink level and an amount of air within the subsidiary ink tank 56 constant, and a valve 58 which acts to close the suction opening 55 under a normal state.

When the suction opening 55 is sucked at a negative pressure higher than a predetermined value by means of a not-shown pump, it communicates with the outside to permit the ink and the air present at the inside thereof to go out. As seen from the drawing, the valve 58 is composed of a sealing ball and a spring used for fixing the ball in place.

As means for adjusting an amount of ink and an amount of air within the subsidiary ink tank, it will be possible to add a suction cap in proximity to the cap of the apparatus as that usable exclusively for the subsidiary ink tank. In this case, a pump, which is coupled to the cap and provides the cap with the suction function, may be integral with or disposed separately from the cap.

It should be noted that the cap covering the discharge port of the head may be commonly used as a suction cap, without disposing a definite purpose cap.

In the case of such a combination as described just above, the number of parts used as suction pump is also reduced to one, so that the construction of the apparatus will not become complex.

Figure 5:
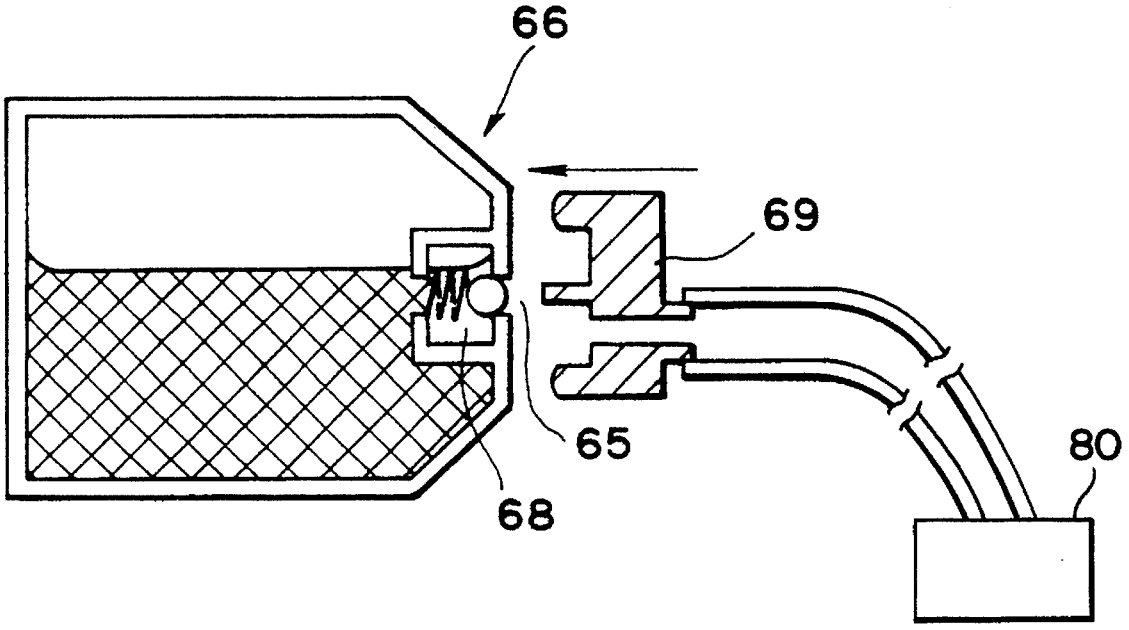
FIG. 5 is a sectional view showing the other example of an ink suction opening of the subsidiary ink tank.
Figure 6:
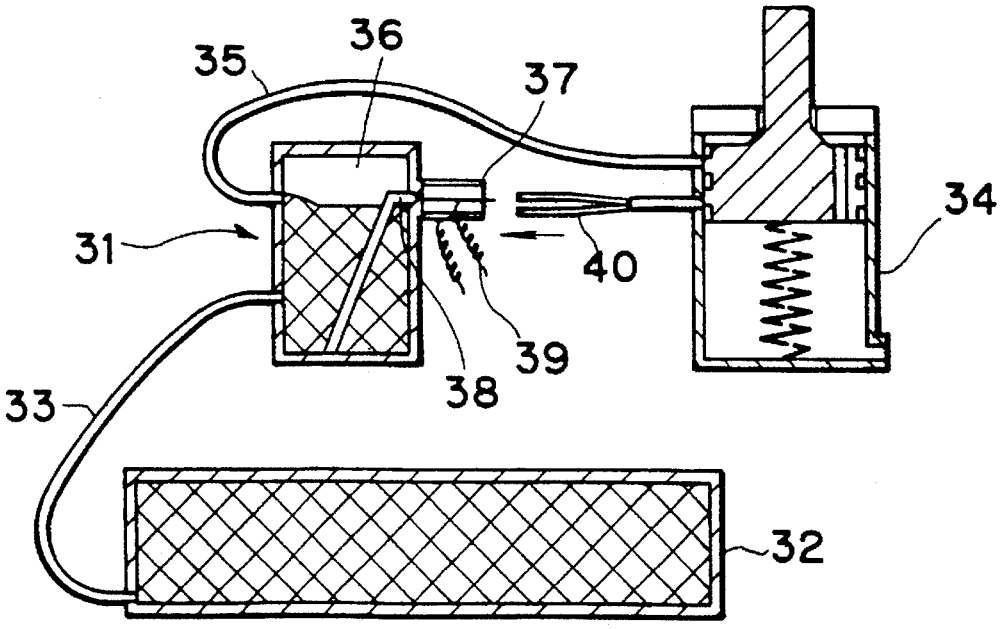
FIG.6 PRIOR ART
FIG. 6 is an explanatory diagram showing one example of the conventional ink jet recording apparatus.
Figure 7:
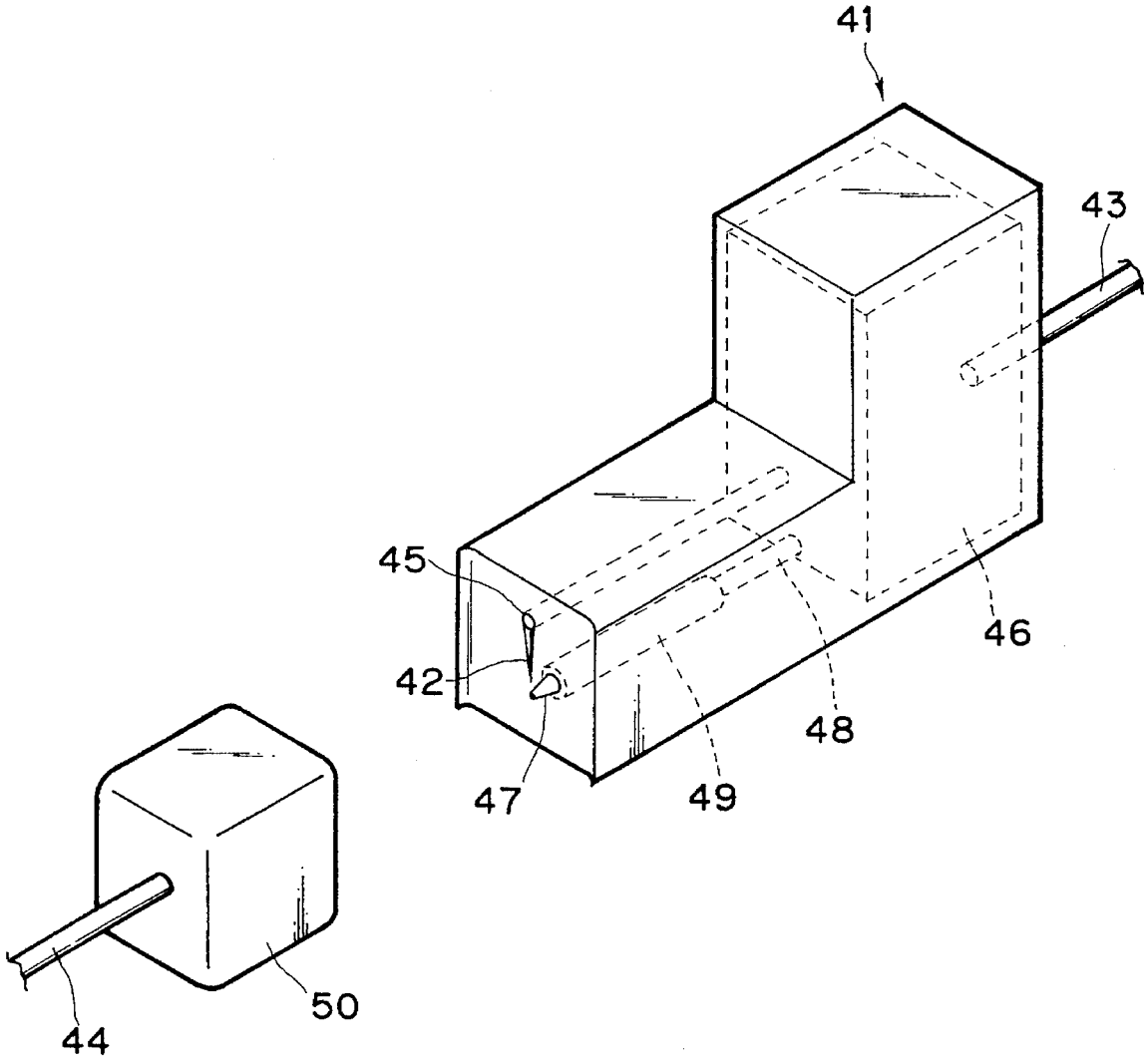
FIG.7 PRIOR ART
FIG. 7 is an explanatory diagram showing another example of the conventional ink jet recording apparatus.

FIG. 5 illustrates a still another embodiment of the present invention.

In this embodiment, a reference numeral 66 shows a subsidiary ink tank, and 65 shows a suction opening which is used for maintaining an ink level and an amount of air within the subsidiary ink tank 66 constant, and interrupted from the outside by means of a valve 68. Like the former embodiment, the valve 68 is composed of a sealing ball, and a spring used for fixing the ball in place.

In the construction of the subsidiary ink tank illustrated in the embodiment of FIG. 5, the communication between the inside and the outside of the suction opening 65 is made possible upon the movement of the ball within the valve 68 from the fixed position by means of a projection formed at the center of a cap 69, and the ink as well as the air within the subsidiary ink tank 66 is discharged by the suction force from a pump 80.

Each of not-shown ink jet heads in FIGS. 3, 4 and 5 is, like FIGS. 2A and 2B, composed of a subsidiary ink tank and additional members disposed adjacent thereto, and is so constituted that it is readily replaceable.

With such construction as explained above adopted, it makes it possible to constitute a simple ink supply system which does not cause any ink leakage from the subsidiary ink tank and any movement of ink along the tube, even in the event of carriage scanning.

According to the present invention, an improved ink supply system with higher reliability, which has no ink leakage from the subsidiary ink tank due to scanning of the carriage as well as pressure variations, can be provided.

As clearly understood from the foregoing, since the stable supply of ink is necessarily achieved, the recording characteristics of the apparatus are expected to be surely improved.

What is claimed is:

1. An ink jet recording apparatus comprising:

an exchangeable head portion for discharging ink to form an image;

an intermediate ink tank for storing ink to be supplied to said head portion, said intermediate ink tank containing an amount of ink and an amount of air;

a main ink tank for supplying ink to said intermediate ink tank;

an ink supply tube connected between said main ink tank and said intermediate ink tank;

a scanning carriage mounting said head portion and said intermediate ink tank; and suction means for regulating the amount of said ink and the amount of said air relative to each other in said intermediate ink tank by moving into and out of contact with said intermediate ink tank, said suction means including a cap provided with a projection portion and a pump connected to the cap for sucking the ink and the air in the intermediate ink tank, wherein an opening is provided in said intermediate ink tank and can be coupled to said suction means, the opening being located above said ink supply tube connected to said intermediate ink tank and covered by an opening/closing mechanism which opens when said suction means is in contact with said intermediate ink tank, said opening/closing mechanism including a ball for sealing the opening and a spring connected to said ball which biases the ball toward the opening, and the ball is pressed by the projection portion of the cap by contacting the cap to the opening, so that said ink and said air are sucked from said intermediate ink tank by the pump as a result of the projection portion pressing on the ball.

2. An apparatus according to claim 1, wherein the cap is only in contact at one end thereof with the opening of the intermediate ink tank.

* * * * *

UNITED STATES PATENT AND TRADEMARK OFFICE

CERTIFICATE OF CORRECTION

PATENT NO. : 5,552,815

DATED : September 3, 1996

INVENTOR(S) : Junji Shimoda

It is certified that error appears in the above-indentified patent and that said Letters Patent is hereby corrected as shown below:

On the title page: Item

[56] References Cited Foreign Patent Documents
"3224959" should read --63-224959--.

COLUMN 1
Line 57, "head" should read --heads--.

COLUMN 2
Line 15, "improve" should read --solve--.

COLUMN 3
Line 46, "inlet" should read --opening--.

Signed and Sealed this

Twenty-ninth Day of April, 1997

*Attest:*

*Attesting Officer*

BRUCE LEHMAN

*Commissioner of Patents and Trademarks*